US006739894B2

(12) United States Patent
Ogura

(10) Patent No.: US 6,739,894 B2
(45) Date of Patent: May 25, 2004

(54) SOCKET FOR IC PACKAGE

(75) Inventor: Shigeru Ogura, Narashino (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 11 days.

(21) Appl. No.: 10/153,638

(22) Filed: May 24, 2002

(65) Prior Publication Data

US 2002/0177347 A1 Nov. 28, 2002

(30) Foreign Application Priority Data

May 25, 2001 (JP) ..... 2001-157657

(51) Int. Cl.[7] ..... H01R 13/62

(52) U.S. Cl. ..... 439/330; 439/73; 439/71; 439/331

(58) Field of Search ..... 439/330, 73, 71, 439/72, 331

(56) References Cited

U.S. PATENT DOCUMENTS 5,249,972 A * 10/1993 Walker ..... 439/330
5,301,416 A * 4/1994 Foerstel ..... 439/330
5,493,237 A * 2/1996 Volz et al. ..... 439/330
5,531,608 A * 7/1996 Abe ..... 439/330
6,280,219 B1 * 8/2001 Sano et al. ..... 439/330

FOREIGN PATENT DOCUMENTS

JP 2000-150092 5/2000

OTHER PUBLICATIONS

Official Letter from Japanese Patent Office for Japanese Patent Application No. 2001–157657 with English translation Oct. 2003.

* cited by examiner

*Primary Examiner*—Javaid H. Nasri
(74) *Attorney, Agent, or Firm*—Finnegan, Henderson, Farabow, Garrett & Dunner, LLP

(57) ABSTRACT

A socket for an IC package avoids deformation or damage of an IC package body. The socket includes a socket body having a receptacle portion of the IC package and a plurality of contacts arranged on a bottom surface of the receptacle portion and resiliently displaceable in up and down directions. Latches are pivotably provided in the socket body and being biased toward the receptacle portion by springs. The socket further includes connecting metals provided for relative motion with respect to the socket body and for moving the latches away from the receptacle portion against the springs, slots and projections restricting motion magnitude toward the bottom surface of the receptacle portion at a predetermined value.

12 Claims, 6 Drawing Sheets

SOCKET FOR IC PACKAGE

This application is based on Patent Application No. 2001-157657 filed May 25, 2001 in Japan, the content of which is incorporated hereinto by reference.

BACKGROUND OF THE INVENTION

1. Field of the Invention

The present invention relates generally to a socket for an IC package. More particularly, the invention relates to a socket for an IC package having a retainer mechanism which can satisfactorily manage contact between terminals of the IC package and contacts of the socket.

2. Description of the Related Art

Conventionally, in a socket for a so-called BGA (Ball grid array) type IC package, in which IC package terminals are formed by hemisphere bumps projecting from a lower surface of the IC package body, there has been a socket employing a plurality of latches. The latches are opened in response to lowering of a retaining cover arranged in an upwardly and downwardly movable condition relative to the socket body. The latches force contact between the IC package body and the plurality of latches biased by springs during an upward movement of the retaining cover. This clamps the IC package body between a mounting surface of the socket body and the latches to attain a predetermined contact pressure between IC package terminals and contacts.

However, in the conventional socket of the form clamping the IC package body between the mounting surface of the socket body and the latches, the IC package body is forced to the mounting surface of the socket body by the latches. It is therefore possible to cause deformation or damage to the IC package body due to fluctuation of the urging force and other causes.

On the other hand, fine metal particles that are created in association with contact between the IC package and the contacts that can accumulate on the mounting surface of the socket body. When the IC package is forced onto the mounting surface, such fine metal particles can be deposited on the IC package to potentially cause shorting between the IC package terminals in the worst case.

Furthermore, since the IC package body is forced by a plurality of spring biased latches, if spring forces are different, biasing forces to be applied to respective latches become different. This may result in causing tilting of the IC package or lateral displacement thereof to impair predetermined contact between the contacts and the IC package terminals.

SUMMARY OF THE INVENTION

It is an object of the present invention to provide a socket for an IC package which can solve the problems set forth above.

In an aspect of the present invention, there is provided a socket for an IC package comprising:

- a socket body having a receptacle portion of the IC package and contacts arranged on a bottom surface of the receptacle portion and resiliently displaceable in up and down directions;
- a latch pivotably provided in the socket body and being biased toward the receptacle portion by spring means;
- latch releasing means, provided for relative movement with respect to the socket body, for moving the latch away from the receptacle portion against spring force applied by the spring means; and
- motion magnitude restricting means for restricting motion magnitude of the latch toward the bottom surface of the receptacle portion.

Here, the receptacle portion may be formed in a positioning base formed separately from the socket body and exchangeable, and the motion magnitude restricting means may be formed at a top portion of the positioning base.

In another aspect of the present invention, there is provided a socket for an IC package comprising:

- a socket body having a quadrangular IC package receptacle portion and a plurality of contacts arranged in a bottom surface of the receptacle portion and resiliently displaceable in up and down directions;
- a pair of latches pivotably provided in the socket body and being biased toward the receptacle portion by spring means;
- latch releasing means, provided for relative movement with respect to the socket body, for moving the pair of latches away from the receptacle portion against the spring means; and
- motion magnitude restricting means for restricting motion magnitude of the pair of latches toward the bottom surface of the receptacle portion.

With one aspect of the present invention, the IC is package is loaded in the condition where the latch is distanced from the receptacle portion against the spring means by the latch releasing means. The IC package is temporarily received within the receptacle portion in a condition where the IC package is arranged on the bottom surface of the receptacle portion and is placed on the contacts resiliently displaceable in up and down directions. In this condition, when the latch releasing means is released, the latch is biased by the spring means toward the receptacle portion as biased by the spring means to downwardly depress the IC package. Associating with depression by the latch, the IC package is lowered to resiliently displace the contacts. Since motion amount of the latch toward the bottom surface of the receptacle portion of the IC package is restricted to the predetermined value by the motion magnitude restricting means, the IC package is stopped at the predetermined position and the IC package body is never urged onto the bottom surface of the receptacle.

Accordingly, even when fluctuation is caused in biasing force by the spring means, the IC package body is never deformed or damaged. Also, fine metal particle will never deposit on the IC package body. Also, the IC package is not inclined or laterally offset so as not to cause failure of predetermined contact between the contacts and the terminals of the IC package.

It should be noted that, with the preferred construction of the present invention, the receptacle portion is formed within the exchangeable positioning base which is formed separately from the socket body. Since the motion magnitude restricting means is formed at the top portion of the positioning base, it is possible to adapt to the configuration of the IC package (dimension and thickness) only by exchanging the position base.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
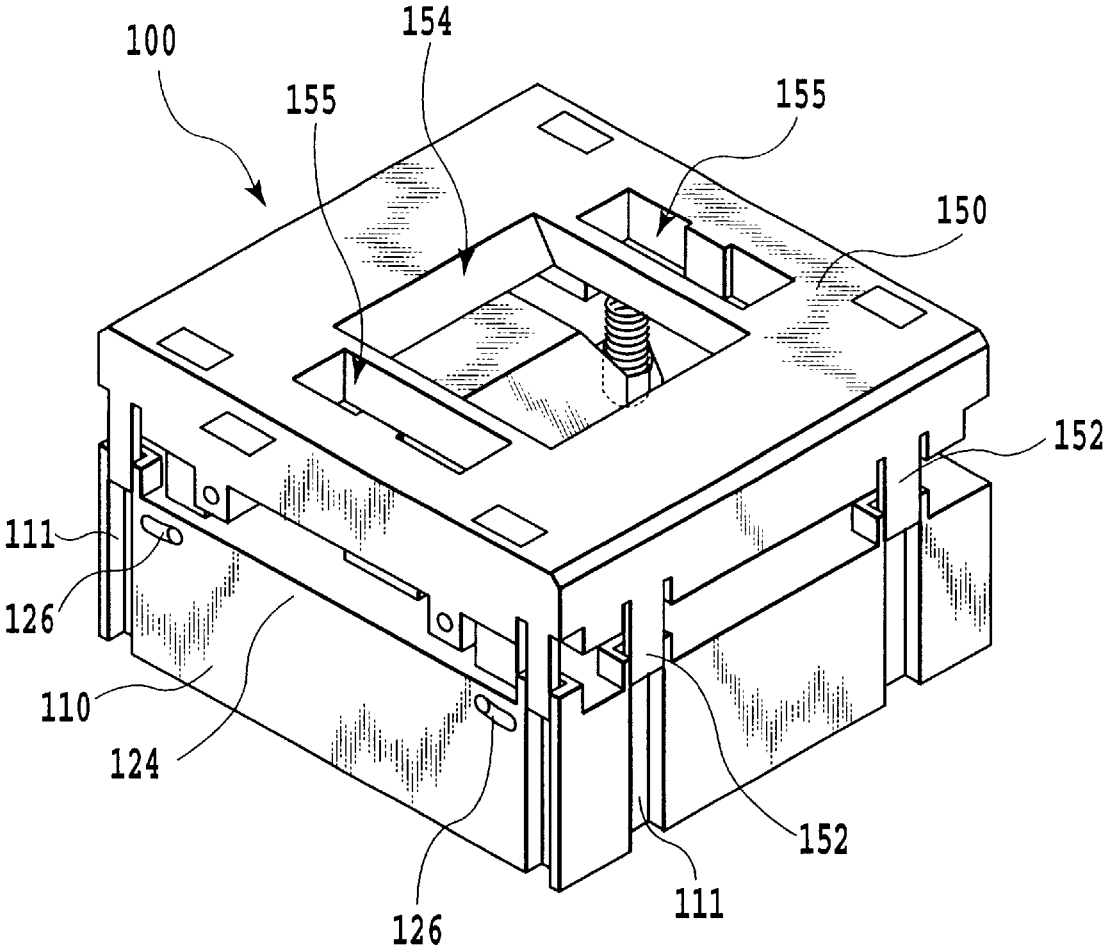
FIG. 1 is a perspective view showing one embodiment of a socket for an IC package according to the present invention.
Figure 2:
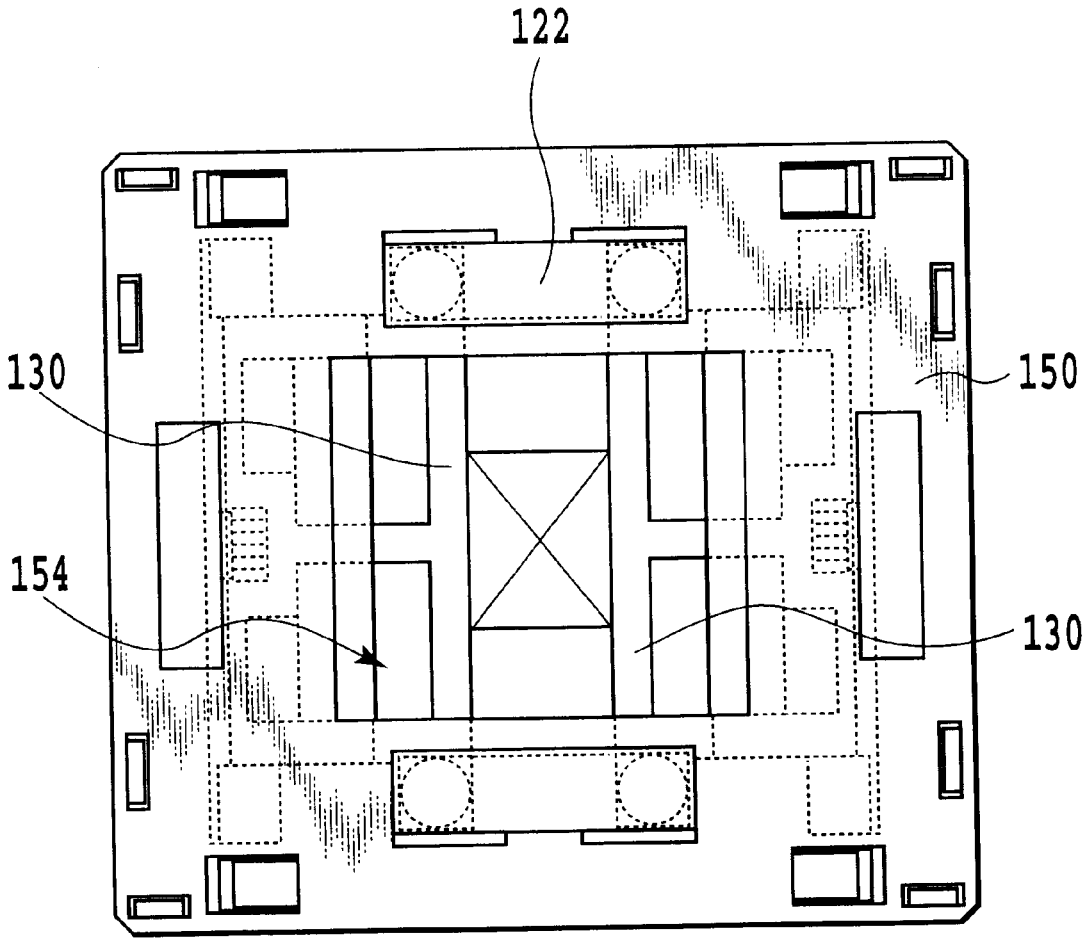
FIG. 2 is a plan view showing one embodiment of the socket for an IC package according to the present invention.
Figure 3:
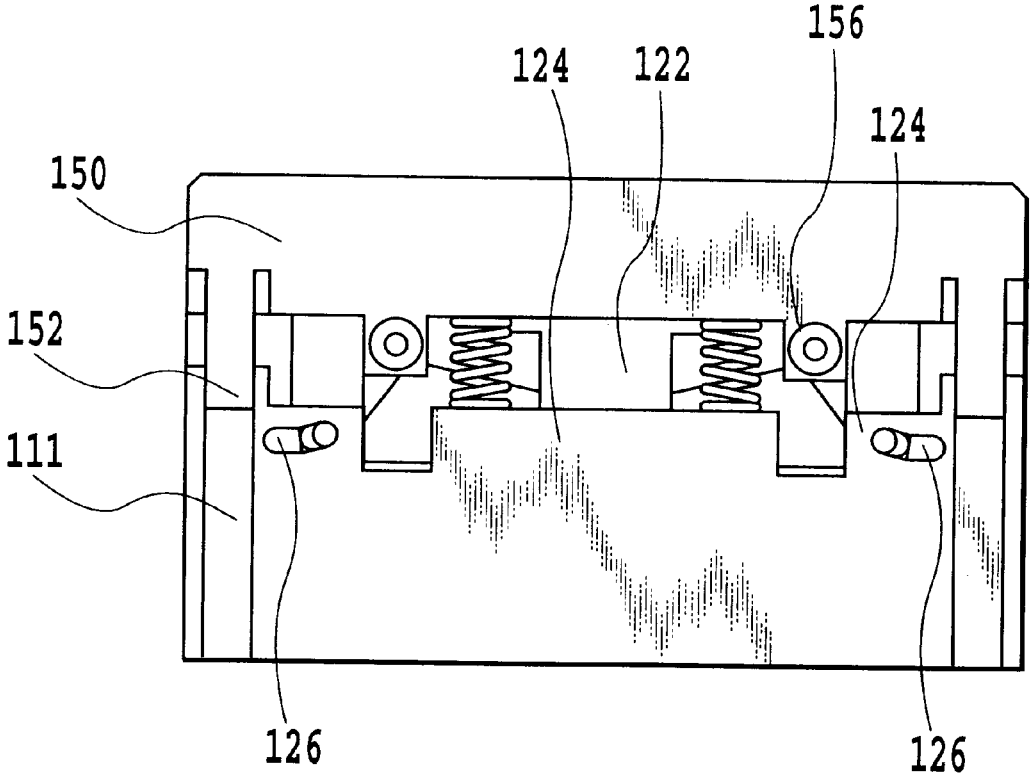
FIG. 3 is a side elevation showing one embodiment of the socket for an IC package according to the present invention.

Preferred embodiments of the present invention will be explained hereinafter in detail with reference to the accompanying drawings.

In the drawings, reference numeral 100 generally denotes an entire socket for an IC package. The socket 100 includes a socket body 110 having a quadrangular shape as viewed from top and formed of an insulative material, such as a resin or the like, and a cover member 150 provided movable relative to the socket body 110 in up and down directions and formed of an insulative material, such as a resin or the like.

A positioning base 114 (FIGS. 4–6) is exchangeably set in a recess portion 112 at the center of the socket body 110. The positioning base 114 is formed with a cavity or recess portion 116 at the center thereof as a receptacle portion for an IC package 200. On a bottom surface in the cavity portion 116 as the receptacle, a plurality of contacts 118 in a form slightly projecting from the bottom surface, are arranged correspondingly to terminals 202 on the lower surface of the IC package 200. As these contacts 118, contact probes which are expandable elastically and linearly in up and down directions may be used. Each of such contact probes may be formed by inserting a pin terminal at each of opposite ends of an outer sleeve, and the pin terminals are resiliently biased by a spring built in the outer sleeve to be extended and retracted. The contact 118 is embedded in the positioning base 114 and the socket body 110 in such a manner that an upper end portion of the pin terminal on the upper side is projected from the bottom surface of the recess portion 116 and the pin terminal on the lower side is projected from the lower surface of the socket body 110. On the other hand, on the top portion of the positioning base 114, as described in detail later, a projection 120 serving as a motion magnitude restricting means for restricting motion magnitude of the latch toward the cavity portion 116, is formed. It should be noted that the positioning base may be formed integrally with the socket body 110.

In the socket body 110, spring support members 122 with T-shaped upper portions are projected on opposite sides of the recess portion 112 located at substantially center position of the socket body 110. On both side walls 124 located on outer sides of the spring support members 122, slots 126 extending substantially in a horizontal direction at its opposite end portions are formed for guiding a pivoting shaft 32 of latches 130.

Reference numeral 130 denotes a pair of latches 20 provided pivotably and movably on the slot body 110 as opposed to each other. In the base end portion of each of the latches, a pivot shaft 132 is provided. The latches 130 have spring support portions at respective ends, and are biased toward the cavity portion 116 as the receptacle portion by means of a spring 134 disposed between the spring support portion and the T-shaped spring support member 122. The latch 130 is formed into a sectionally bill shaped configuration at its distal end. On the lower side, the latch 130 is formed with a tilted surface 136 substantially parallel to a tilted surface 121 extending as part of the projection 120 formed at the top of the positioning base 114.

The cover member 150 has a plurality of tongue shaped strips 152 extending downwardly from the lower end portions thereof. The tongue shaped strips 152 with a plurality of guide grooves 111 formed on the circumferential surface of the socket body 110 for permitting up and down movement of the cover member 150 relative to the socket body 110. The cover member 150 is formed with an opening 154 for insertion of an IC package substantially at the center portion. On both sides of the opening 154, openings 155 for accommodating the T-shaped spring support member 122 are formed. The cover member 150 is also provided pin support portions 156 projecting downward from the lower surface. A connecting metal 140 is engaged with a pin supported by the pin supporting portion 156 and a pivot shaft 132 of the latch 130 for connecting the cover member 150 and the latch 130 with each other. Thus, the cover member 150 and the latch 130 are relatively movable relative to the socket body 110. By a relationship between the connection metal 140 connecting the cover member 150 and the latch 130, and the slot 126 guiding the pivot shaft 132 of the latch 130, a latch releasing means for releasing the latch 130 from the cavity portion 116 as the receptacle portion against the biasing force of the spring 134 is formed.

Figure 4:
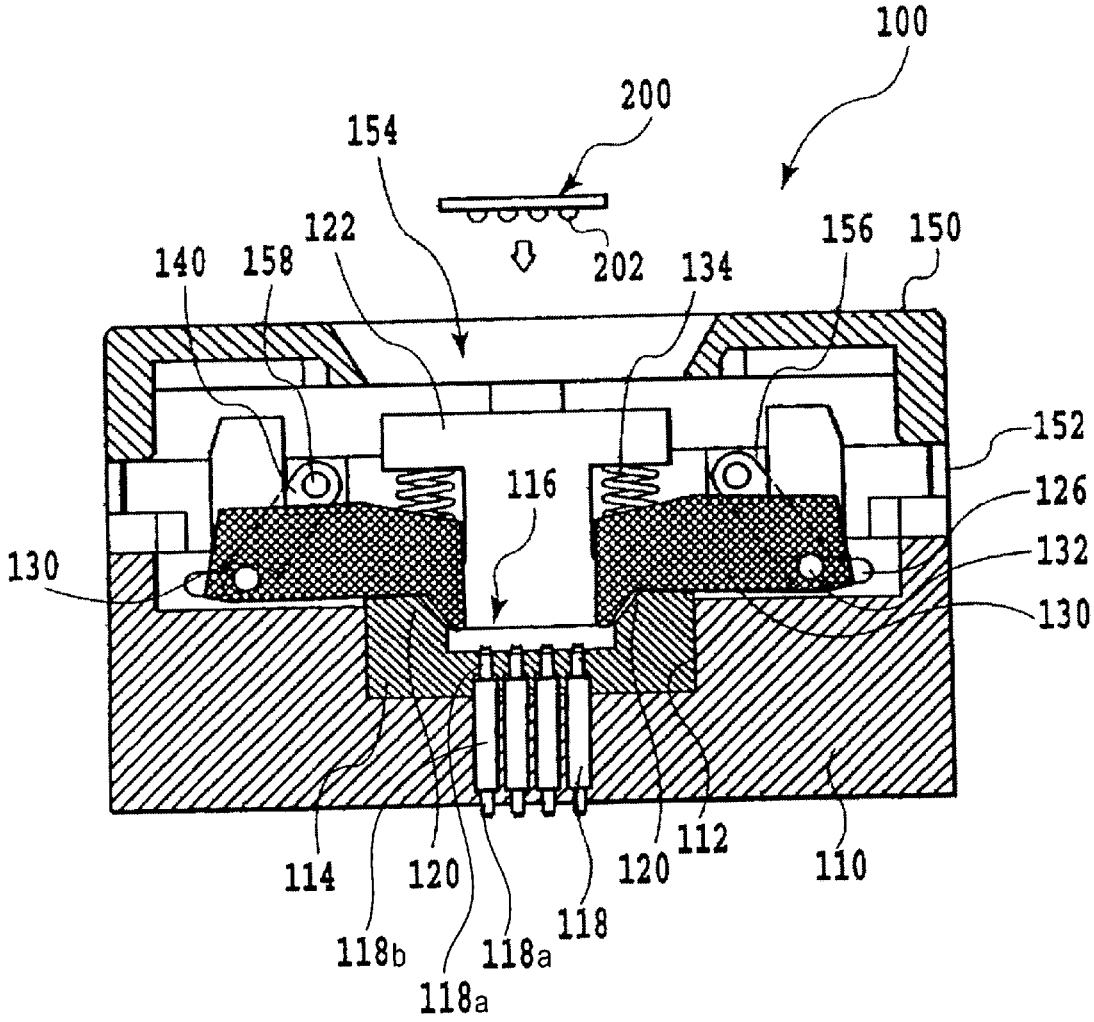
FIG. 4 is a section showing one embodiment of the socket for an IC package according to the present invention, in which is illustrated a normal condition where an IC package is not mounted.
Figure 5:
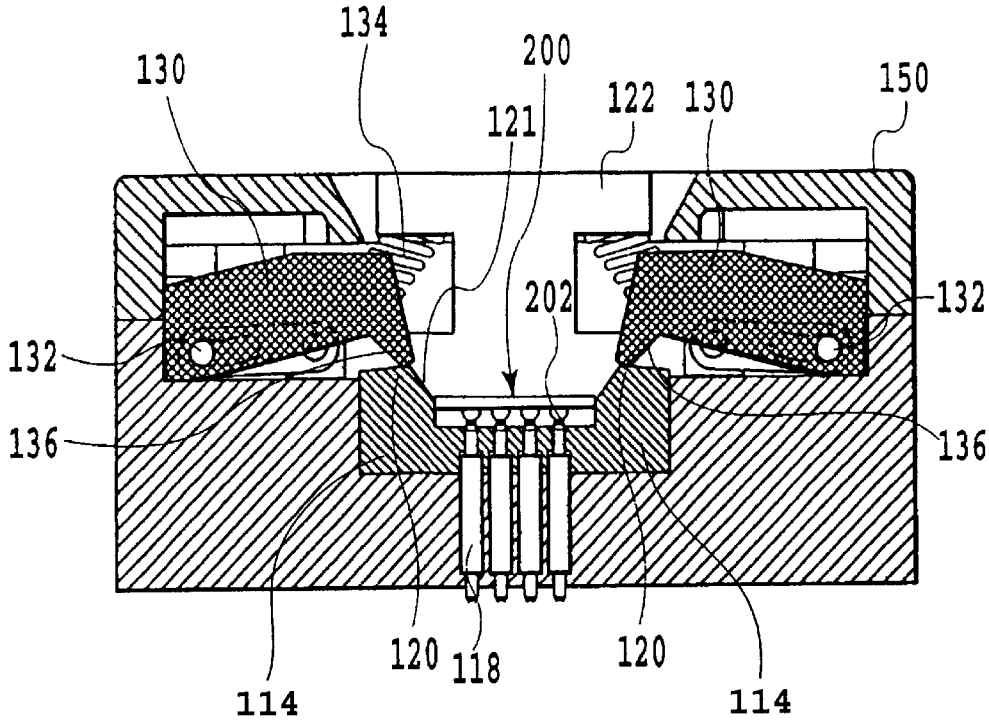
FIG. 5 is a section showing one embodiment of the socket for an IC package according to the present invention, in which is illustrated a condition where latches are opened and an IC package is mounted.
Figure 6:
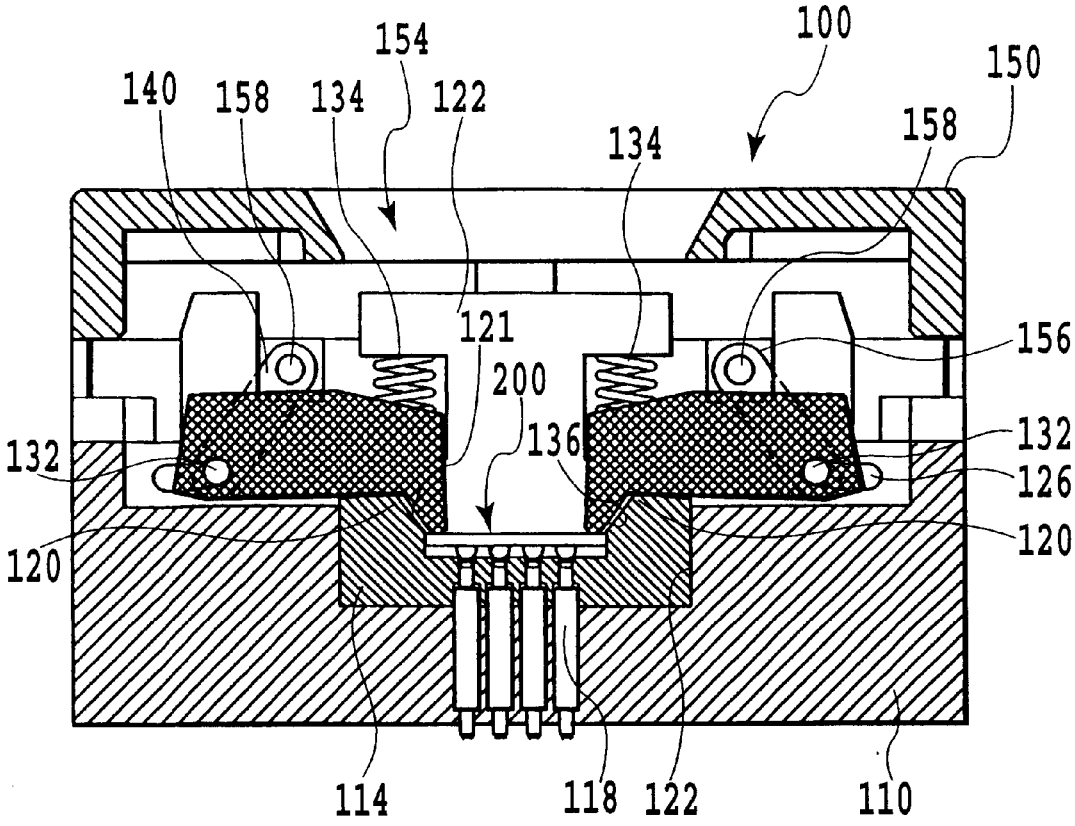
FIG. 6 is a section showing one embodiment of the socket for an IC package according to the present invention, in which is illustrated a condition where the IC package is mounted and the latches are closed.

With reference to FIGS. 4 to 6, operation of the socket 100 for the IC package constructed as set forth above, will be explained hereinafter.

FIG. 4 shows a normal condition where the IC package 200 is not loaded. As shown in FIG. 5, when the cover member 150 is lowered as depressed by a not shown robot actuator or the like, the pivoting shaft 132 of the latch 130 is pushed via the connection metal 140 to be guided horizontally outside within the slot 126. Associating with this, the latch 130 is pivoted as guided the tilted surface 136 by the tilted surface 121 of the positioning base 114 with deflecting the spring 134. At the same time, the latch 130 is moved away from the cavity portion 116 to open the cavity portion 116.1 At this time, the IC package 200 is inserted through the opening 154 of the cover member 150. The inserted IC package 200 is received within the cavity portion 116 as the receptacle portion as guided by the tilted surface 121 of the positioning base 114, and then terminals 202 on the lower surface is mounted on the upper ends of respective contacts 118.

Next, bias force on the cover member 150 by the robot actuator and so forth is released, the cover member 150 is moved upward by restoration force of the spring. Then, the connecting metal 140, one end of which is engaged with the pin 158 supported on the pin supporting portion 156 integral with the cover member 150, is pulled up at one end. The pivot shaft 132 of the latch 130 is guided horizontally inward within the slot 126. Associating with this, the latch 130 is moved toward the cavity portion 116 as guided the tilted surface 136 by the tilted surface 121 of the positioning base 114. The sectionally bill-shaped tip end contacts on the upper surface of the IC package 200. Then, finally, as shown in FIG. 6, the latches 130 lower the IC package 200 while resiliently depressing the contact 118 downwardly, until the lower surface of the latch 130 engages with the projection 120 of the positioning base 114 so that pivotal motion and movement of the latches 130 are restricted.

In this final condition, the IC package 200 is held by the latches 130 and the contacts 118 with the terminals 202 on the lower surface of the IC package 200 contacting with the contacts 118 and with resilient restoration force of the elastically deformable contacts 118 with a predetermined contact pressure. However, the lower surface of the main body of the IC package 200 does not contact with any element. Since the latch 130 is engaged with the projection 120 of the positioning base 114 at the lower surface, the biasing force of the spring 134 does not affect for the contact pressure of the contacts 118. On the other hand, even if fluctuation is caused in the spring forces in the left and right springs, attitude of the IC package is not affected by such fluctuation.

It should be noted that while an embodiment where the present invention is applied for the socket for the IC package of the type in which latches are pivotable and movable relative to the socket body has been described in the shown embodiment, the present invention is also applicable for the socket of the type having pivotal latch levers for simply pivoting and depressing an IC package by means of a torsion spring or the like provided in the socket body.

As can be clear from the explanation set forth above, with the present invention, deformation or damaging of the IC package body can be avoided even when fluctuation of the biasing force by the spring means is present. Furthermore, fine metal particle or the like will never be deposited on the IC package body. Furthermore, inclination of the IC package or lateral displacement will never be caused and contact failure between the contacts and the terminals of the IC package will not be caused.

The present invention has been described in detail 20 with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A socket for an IC package comprising:

a socket body having a receptacle portion for the IC package and contacts arranged on a bottom surface of said receptacle portion, wherein the contacts are resiliently displaceable in an up and a down direction;

a latch pivotably provided in said socket body and biased toward said receptacle portion by spring means;

latch releasing means, provided for relative movement with respect to said socket body, for moving said latch away from said receptacle portion against a spring force applied by said spring means; and motion magnitude restricting means for restricting the movement of said latch toward said receptacle portion to a predetermined position, so that the spring force is prevented from exerting any pressure on the contacts past the predetermined position.

2. A socket for an IC package as claimed in claim 1, wherein said receptacle portion is formed in a positioning base formed separately and exchangeable from said socket body, and said motion magnitude restricting means formed at a top portion of said positioning base.

3. A socket for an IC package as claimed in claim 1, further comprising a cover member provided for relative motion in the up and down directions with respect to said socket body and having an opening at a center portion thereof.

4. A socket for an IC package as claimed in claim 2, further a cover member provided for relative motion in the up and down directions with respect to said socket body and having an opening at a center portion thereof.

5. A socket for an IC package as claimed in claim 4, wherein said latch releasing means includes a connection metal connecting said cover member and a pivot shaft of said latch and a slot formed in said socket body for guiding said pivot shaft of said latch.

6. A socket for an IC package as claimed in claim 5, wherein said latch includes a sectionally bill shaped tip end portion an on opposite side of said pivot shaft and a first tilted surface on a lower side of said pivot shaft, and said positioning base formed with a second tilted surface formed substantially parallel to said first tilted surface.

7. A socket for an IC package comprising:

a socket body having a quadrangular IC package receptacle portion and a plurality of contacts arranged in a bottom surface of said receptacle portion, said contacts resiliently displaceable in an up and a down direction;

a pair of latches pivotably provided in said socket body and being biased toward said receptacle portion by spring means;

latch releasing means, provided for relative movement with respect to said socket body, for moving said pair of latches away from said receptacle portion against said spring means; and motion magnitude restricting means for restricting the movement of each latch toward said receptacle portion to a predetermined position for each latch, so that the spring force is prevented from exerting any pressure on the contacts past each predetermined position.

8. A socket for an IC package as claimed in claim 7, wherein said receptacle portion is formed in a positioning base formed separately and exchangeable from said socket body, and said motion magnitude restricting means formed at a top portion of said positioning base.

9. A socket for an IC package as claimed in claim 7, further comprising a cover member provided for relative motion in the up and down directions with respect to said socket body and having an opening at a center portion.

10. A socket for an IC package as claimed in claim 8, further comprising a cover member provided for relative motion in the up and down directions with respect to said socket body and having an opening at a center portion.

11. A socket for an IC package as claimed in claim 10, wherein said latch releasing means includes a pair of connection metals connecting said cover member and pivot shafts of said pair of latches and a pair of slots formed in said socket body for guiding said pivot shafts of said pair of latches.

12. A socket for an IC package as claimed in claim 11, wherein each of said latches includes a sectionally bill shaped tip end portion on an opposite side of said pivot shaft and a first tilted surface on a lower side, and said positioning base having a second tilted surface formed substantially parallel to said first tilted surface.

* * * * *